US011919668B2

(12) United States Patent
Orr

(10) Patent No.: US 11,919,668 B2
(45) Date of Patent: Mar. 5, 2024

(54) METHOD AND APPARATUS FOR ELIMINATING OXYGEN IN THE FILLING OF A FLEXIBLE BAG WITH A BEVERAGE

(71) Applicant: Timothy E. Orr, Redding, CA (US)

(72) Inventor: Timothy E. Orr, Redding, CA (US)

(73) Assignee: TORR INDUSTRIES, INC., Redding, CA (US)

( * ) Notice: Subject to any disclaimer, the term of this patent is extended or adjusted under 35 U.S.C. 154(b) by 0 days.

(21) Appl. No.: 17/855,448

(22) Filed: Jun. 30, 2022

(65) Prior Publication Data

US 2022/0388697 A1 Dec. 8, 2022

Related U.S. Application Data

(63) Continuation of application No. 17/175,390, filed on Feb. 12, 2021, now Pat. No. 11,518,560.

(51) Int. Cl.

| | |
|---|---|
| ***B65B 3/04*** | (2006.01) |
| ***B65B 31/02*** | (2006.01) |
| ***B65B 31/04*** | (2006.01) |
| ***B65B 31/06*** | (2006.01) |
| ***B65B 55/02*** | (2006.01) |
| ***B65B 55/10*** | (2006.01) |

(52) U.S. Cl.

CPC ..... *B65B 3/045* (2013.01); *B65B 31/024* (2013.01); *B65B 31/044* (2013.01); *B65B 31/06* (2013.01); *B65B 55/022* (2013.01); *B65B 55/027* (2013.01)

(58) Field of Classification Search

CPC ..... B65B 55/022; B65B 31/06; B65B 31/044; B65B 31/024; B65B 3/045

See application file for complete search history.

(56) References Cited

U.S. PATENT DOCUMENTS

| | | | | |
|---|---|---|---|---|
| 4,120,134 | A * | 10/1978 | Scholle | B65B 43/123 53/472 |
| 4,445,550 | A * | 5/1984 | Davis | B65D 37/00 141/330 |
| 4,446,674 | A * | 5/1984 | Inada | B65B 1/34 53/502 |
| 4,494,363 | A * | 1/1985 | Rica | B65B 7/2878 53/88 |
| 4,519,184 | A * | 5/1985 | Brunswick | B67B 7/26 53/503 |
| 4,731,978 | A * | 3/1988 | Martensson | B60M 3/04 53/381.1 |
| 6,330,780 | B1 * | 12/2001 | Shipway | B65B 55/022 53/426 |
| 10,059,476 | B2 * | 8/2018 | Parisini | B65B 55/10 |
| 2004/0139704 | A1 * | 7/2004 | Savage | B65B 55/10 53/469 |
| 2017/0158366 | A1 * | 6/2017 | Decio | B65B 43/26 |

* cited by examiner

*Primary Examiner* — Andrew M Tecco
(74) *Attorney, Agent, or Firm* — Theodore J. Bielen, Jr.

(57) ABSTRACT

Method and apparatus for eliminating oxygen in the filling of a flexible bag with a beverage utilizing sources of inert gas, vacuum, and beverage. A filling head regulates the injection of inert gas and applies a vacuum to the flexible bag the bag spout. The bag spout is separately rinsed of oxygen prior to recapping the same on the flexible bag.

1 Claim, 4 Drawing Sheets

METHOD AND APPARATUS FOR ELIMINATING OXYGEN IN THE FILLING OF A FLEXIBLE BAG WITH A BEVERAGE

CROSS-REFERENCE TO RELATED APPLICATION

The present application is a Continuation of U.S. patent application Ser. No. 17/175,390, filed 12 Feb. 2021.

BACKGROUND OF THE INVENTION

The present application relates to a novel and useful apparatus for eliminating oxygen in the filling of a flexible bag with a beverage such as wine.

Dissolved oxygen in wine is normally considered to be a detrimental occurrence. For example, excess oxygen in wine is capable of reducing aging potential and creating chemical reactions that influence the wine color and flavor, as well as effecting the loss of varietal character. Such developments in wine are due to enzymatic oxidation, chemical oxidation, microbial oxidation, and the like. For example, enzymatic oxidation via polyphenol oxidase (PPL) produces quinones, which cause wines to develop a brownish tint and an oxidative odor of acetaldehyde. Another enzyme, laccase, also causes browning and decreases varietal aromas in wine.

Chemical oxidation, the main oxidative process in wines, causes oxidation of polyphenols forming quinones and hydrogen peroxidase. The latter converts ethanol into acetaldehyde resulting in a Sherry-like aroma and a brown-yellow discoloration and aroma degradation. Other wine negative effects take place due to microbial oxidation, which is dependent upon oxygen being present in the wine.

Needless to say, the removal of oxygen from wine and other beverages is most important to maintain quality on various levels.

The elimination of oxygen is extremely important during the bottling or filling process, such as where wine is transferred from a cask or bulk container to a bottle or bag. In the past, inert gasses such as nitrogen and carbon dioxide have been used to purge the container being filled in order to eliminate oxygen entering the beverage within the container. However, a significant amount of oxygen enters a wine container during filling through the uncapping and recapping of the beverage container. Such ingress of oxygen is especially acute at the spout or fitment area of a flexible bag.

The removal of oxygen during the filling process of a flexible bag from a beverage such as wine is needed to preserve color and sensory characteristics.

It is therefore an object of the present application to provide a method and apparatus for filling a flexible bag with a beverage that removes oxygen from the flexible bag chamber and the spout of a flexible bag, simultaneously.

Another object of the present application is to provide a method and apparatus for eliminating oxygen in the filling of a flexible bag with a beverage that separately purges oxygen from the flexible bag and spout and rinses oxygen from the cap prior to recapping of the bag.

Another object of the present application is to provide a method and apparatus for substantially eliminating oxygen in the filling of a flexible bag with a beverage that removes residual product drips in the fill valve surfaces prior to sealing flexible bag with an oxygen rinsed cap.

Another object of the present application is to provide a method and apparatus for substantially eliminating oxygen in the filling of a flexible bag with a beverage that results in the oxygen level of the beverage of the fill bag to lie at a far lower level than that attained by prior art devices.

Another object of the present application is to provide a method and apparatus for substantially eliminating oxygen in the filling of a flexible bag with a beverage that permits consistent bag filling mechanics.

Another object of the present application is to provide a method and apparatus for substantially eliminating oxygen in the filling of a flexible bag with a beverage which may be employed in a continuous procedure utilizing multiple flexible bags.

Another object of the present application is to provide a method and apparatus for substantially eliminating oxygen in the filling of a flexible bag with a beverage that greatly avoids the detrimental effects of oxygen on beverages such as wine due to oxidation forces.

The application possesses other objects and advantages especially as concerns particular characteristics and features thereof which will become apparent as the specification continues.

Figure 1:
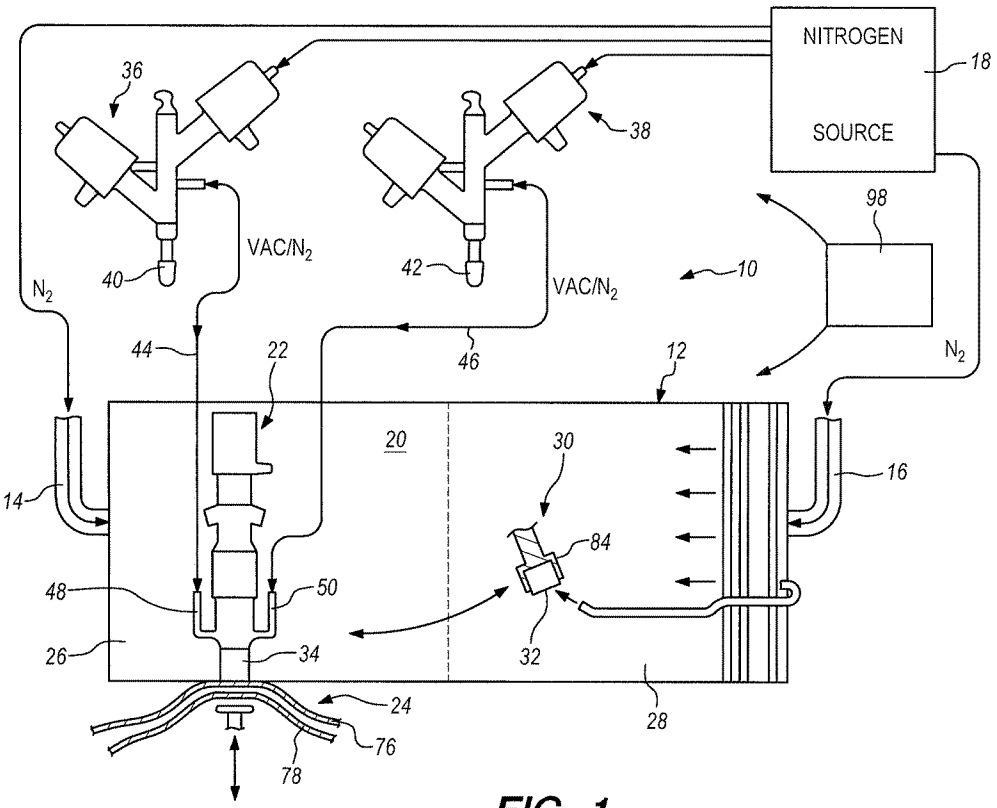
FIG. 1 is an overall schematic view of the apparatus of the present application.

For a better understanding of the application, reference is made to the following detailed description of the preferred embodiments thereof, which should be referenced to the prior disclosed drawings.

SUMMARY OF THE INVENTION

In accordance with the present application, an apparatus for greatly eliminating oxygen in the filling of a flexible bag is hereinafter described.

The apparatus of the present application utilizes a source of inert gas, such as nitrogen. Also, a source of vacuum is provided with the apparatus of the present application.

The apparatus further includes a filling head which includes a conduit for a beverage, such as wine, a conduit for the inert gas emanating from the source of inert gas, and a conduit for a vacuum originating from the source of vacuum. The filling head also includes an outlet communicating with the beverage inert gas conduit, the vacuum conduit, and the beverage source.

The apparatus is also provided with a first valve for selectively regulating the flow of the inert gas and vacuum through the inert gas and vacuum conduits to the outlet of the filling head. A second valve regulates the flow of the beverage to the outlet of the filling head.

A shroud is also provided having a first portion for substantially surrounding the filling head. The shroud also includes a second portion for substantially surrounding the closure cap employed to stop the bag spout of the flexible bag. The shroud first portion communicates with the shroud second portion.

A holder is found in the present apparatus for supporting the cap in the shroud second portion. A nozzle is connected to the source of inert gas and positioned to direct inert gas at a high velocity onto the closure cap supported by the holder in the shroud second portion. The shroud second portion further includes an inlet from the source of inert gas.

The inert gas second portion may also possess a diffuser for directing the flow of inert gas from the inlet, at a relatively low velocity, to the shroud second portion apart from the nozzle directing inert gas directly to the closure cap supported by the closure cap holder. Needless to say, the first portion of the shroud also includes an inlet communicating with the source of inert gas.

A prior art bag closure pad is also employed in the present apparatus and is movable to bias the flexible bag into a sealing configuration about the bag's spout or fitment.

The apparatus heretofore described is also employed with a method or process which includes loading and sealing the bag to the filling head.

Initially, the bag closure pad is the raised to seal the lower portion or film of the bag against the bag spout. This step insures that gasses do not enter the bag during the uncapping process. The cap is then lifted out of the spout and rotated into a portion of the shroud which is employed to create an inert gas atmosphere about the apparatus.

The filling valve of the filling head is then lowered and sealed against the filling head spout. At this point, the bag closure pad is lowered to allow a path for air to be vacuumed out of the bag for a specific length of time, typically 0.25 seconds. Vacuum is then applied to the bag from the source of vacuum employed with the apparatus of the present application.

Following vacuuming of the bag, the bag closure pad is again raised and forced against the spout. This step isolates the spout from the bag chamber. Inert gas is then delivered via the valve mechanism to the spout simultaneously with the application of vacuum to the spout through a separate conduit. This step cross-flushes residual oxygen from the spout and simultaneously purges oxygen from the vacuum conduits communicating with the filling head.

The delivery of inert gas and vacuum to the spout via the filling head is then stopped. The closure pad is then lowered, and products such as wine or other beverage is delivered to the bag via the filling head. Following the dosing of beverage into the bag, nitrogen is then again injected into the spout for an elapsed time, typically 0.05 seconds, to push beverage into the bag and to clear the spout of residual liquid. The bag closure pad is then again raised to seal the product into the bag.

Subsequently, the product filling valve is lifted to a "seal break" position and paused for a set period of time. Vacuum is then applied to remove residual product drips adhering to the filling valve surface. The cap, separate from the bag, is then rinsed of oxygen by the directing of inert gas to the cap in the shroud chamber. The cap is then again moved over the spout to recap the filled beverage bag.

It may be apparent that a novel and useful method and apparatus for eliminating oxygen in filling a flexible bag has been hereinabove described.

DETAILED DESCRIPTION OF THE PREFERRED EMBODIMENTS

Various aspects of the present application will evolve from the following detailed description of the preferred embodiments thereof which should be referenced to the prior delineated drawings.

With reference to FIG. 1, it may be observed that the apparatus 10 of the present application is revealed in schematic format. Apparatus 10 includes as one of its elements a shroud or enclosure 12, which is normally filled with an inert gas such as nitrogen. Concerning FIG. 1, inlets 14 and 16 direct nitrogen from nitrogen source 18. Thus, the interior 20 of shroud 12 lies under a positive inert gas pressure due to the inert gas passing through inlets 14 and 16. Apparatus 10 also has a filling head 22 which directs nitrogen, vacuum, or beverage to outlet 66, detailed hereinafter. Shroud 12 is generally divided into a first portion 26 for enclosing filling head 22. Second portion 28 of shroud 12 includes an oxygen rinsing station 30 for closure cap 32 intended to fit on the spout portion 34 of flexible bag 24. Valve pairs 36 and 38 regulate the application of vacuum and/or the injection of nitrogen to filling head 22. Vacuum is generated at vacuum inlets 40 and 42 of valve pairs 36 and 38, respectively. Nitrogen source 18 also feeds valve pairs 36 and 38 as well as inlets 14 and 16 of shroud 12. Each valve pair 36 or 38 may consist of an air actuated sanitary angle seat valve to inject nitrogen into either conduit 44 or 46 and a vacuum generator. The air actuated sanitary angle seat valve may be one similar to that manufactured by Genn Hydro Tech of Kupferzell, Germany. The vacuum generator may be a model manufactured by Torr Industries, Inc. of Redding, California.

Figure 2:
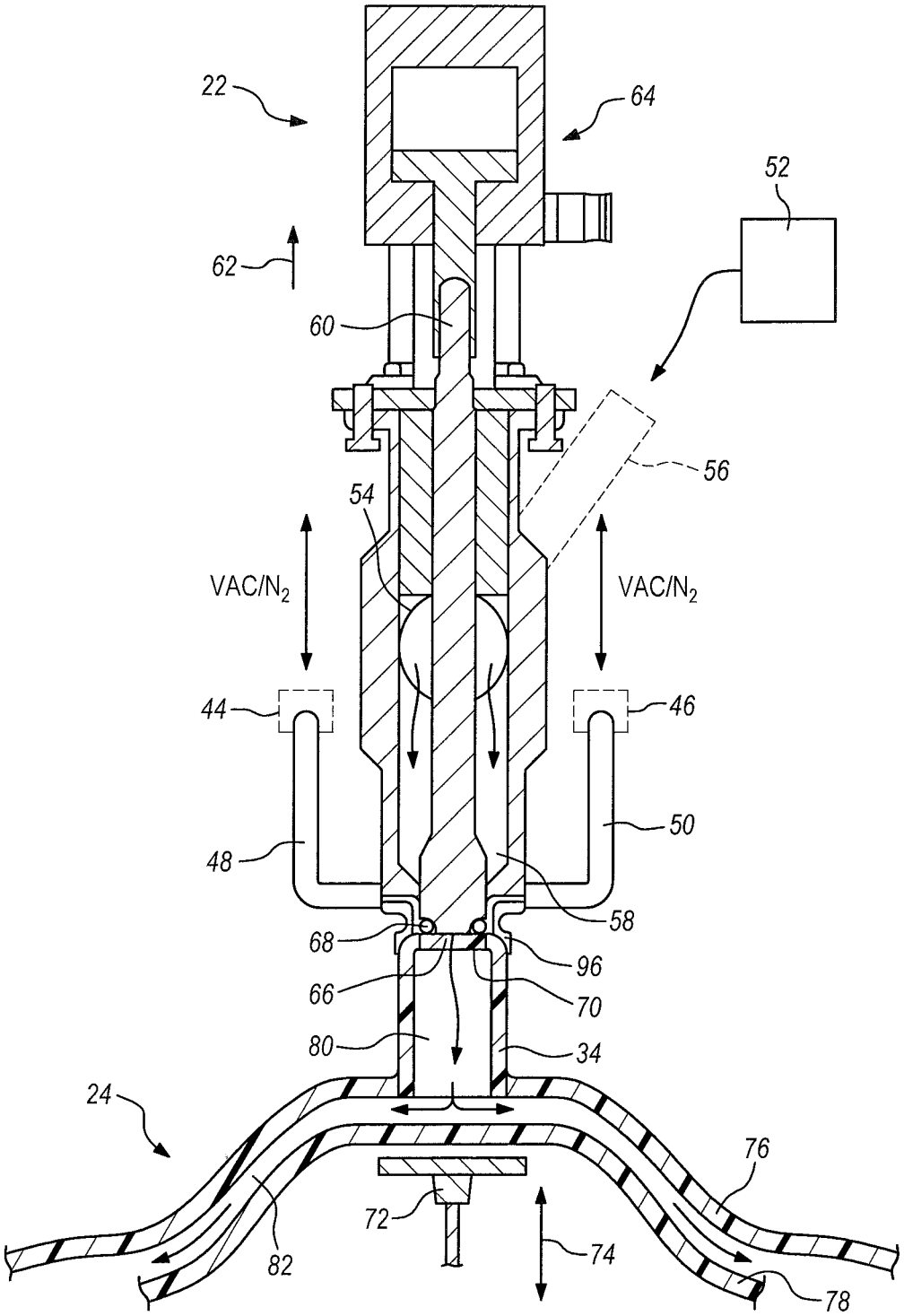
FIG. 2 is sectional view showing the filling valve portion of the apparatus in conjunction with a flexible bag and bag closure, partially illustrated.

Conduits 44 and 46 deliver vacuum and/or nitrogen to tubes 48 and 50 of filling head 22. Beverage intended to fill flexible bag 24 is passed from beverage source 52 to beverage inlet 54 of filling head 22 via beverage channel 56, FIG. 2. Beverage from beverage source 52 eventually enters a chamber 58 within filling head 22. Beverage fill valve stem 60 within filling head is capable of moving upwardly, directional arrow 62, via a servo mechanism 64. As depicted in FIG. 2, beverage fill valve stem is in a down position isolating chamber 58 from outlet 66 of filling head 22. Outlet 66 of filling head 22 also communicates with nitrogen source 12 and vacuum inlets 40 and 42 via tubes 48 and 50 having exits 68 and 70 at filling head 22, respectively.

Again viewing FIG. 2, it may be observed that a bag closer pad 72, of prior art configuration, is able to move up and down, according to directional arrow 74. The use of bag closer pad 72 has been expanded herein, from employment in the prior art, to control the amount of inert gas injected into the flexible bag 24 and/or the spout 34. Bag closer pad 72 is able to squeeze a lower film 78 of flexible bag 24 against the connected upper film 76. When this occurs, the interior 80 of spout 34 is isolated form the interior 82 of flexible bag 24. As depicted in FIG. 2, the closure cap 32 of flexible bag 24 has been removed to shroud chamber 20 second portion 28.

Figure 3:
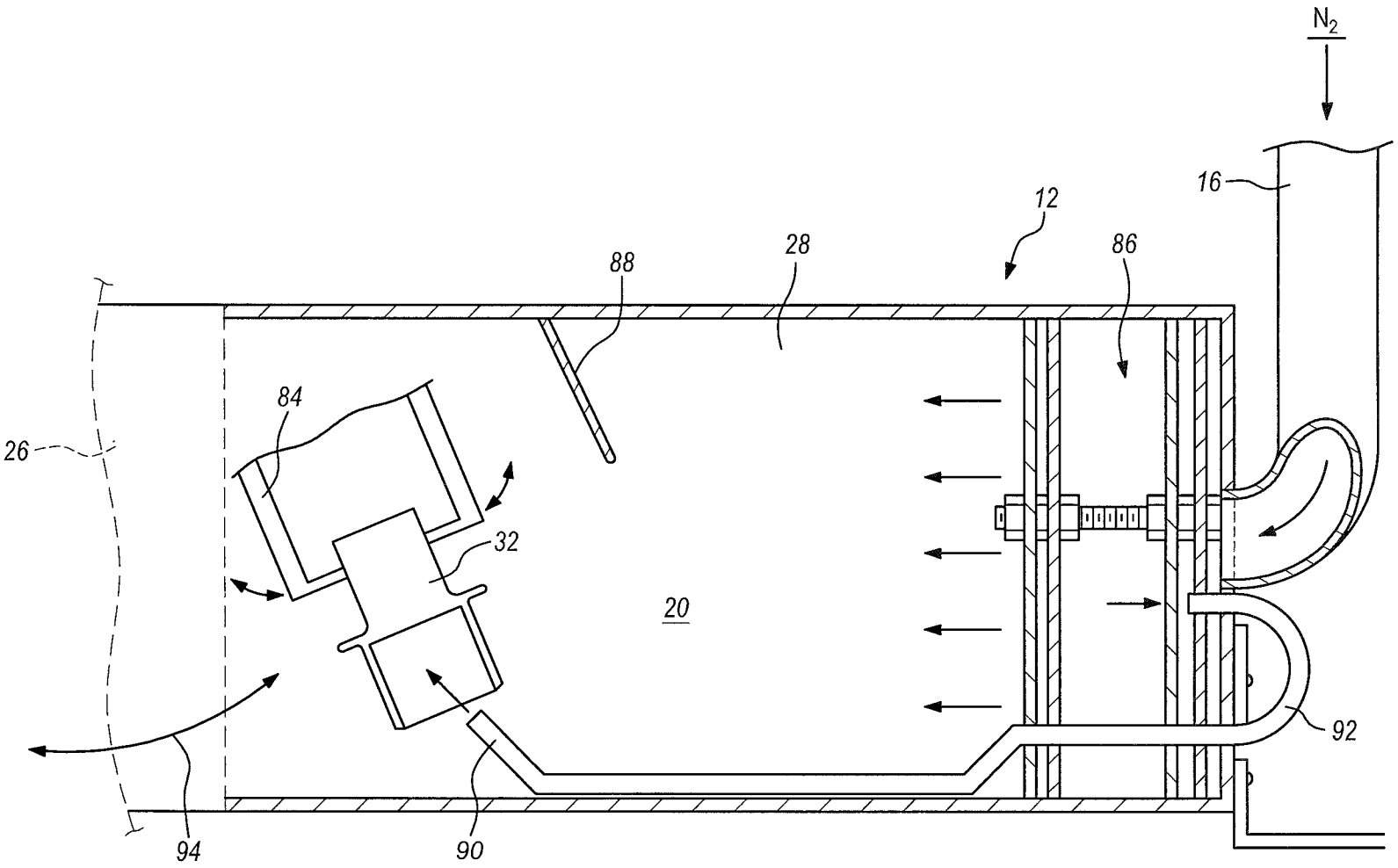
FIG. 3 is a side elevational view of a portion of the inert gas shroud illustrating the oxygen rinsing of the closure cap for the flexible bag prior to recapping of the flexible bag.
Figure 4:
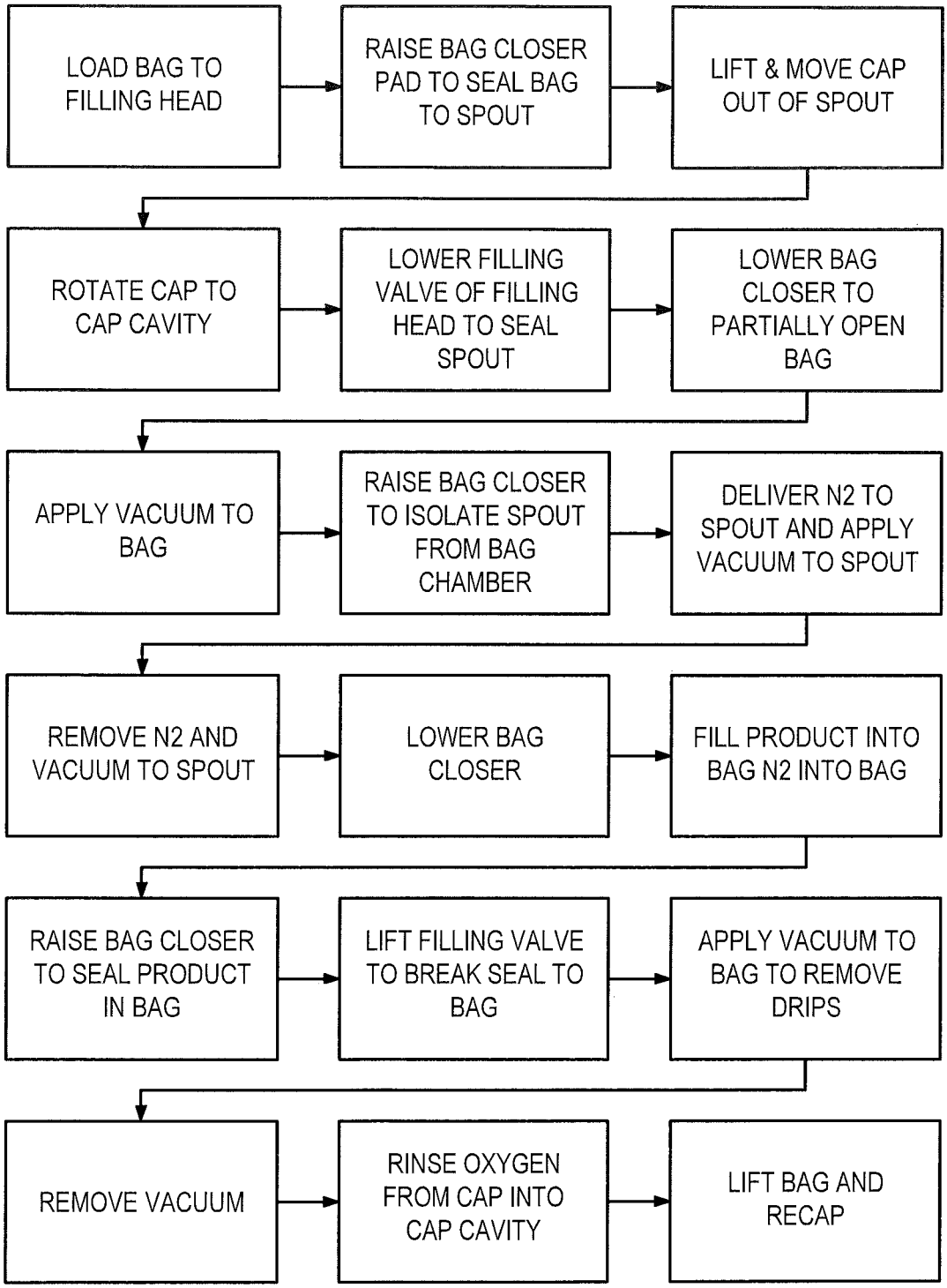
FIG. 4 is a block diagram delineating the method used for eliminating oxygen in the filling of the flexible bag.

Viewing now FIG. 3, it may be apparent that shroud 12 second portion 28 is depicted in greater detail with cap 32 being held by gripper 84. Gripper 84 is connected to a mechanism that is capable of swinging cap 32 into and out of chamber 12 second portion 28 and over the top of spout 34 when bag 24 is to be recapped. Such mechanism is of known prior art and conventional configuration. The purpose of second portion 28 of shroud 12 is to allow the focused oxygen rinsing of closure cap 32. In this regard, nitrogen is forced into second portion 28 of shroud 12 via inlet 16. Diffuser plates 86 and baffle 88 within second portion 28 of shroud 12 moves nitrogen passing through inlet 66 at a relatively low velocity. A nozzle 90 receives nitrogen from the interior 20 of shroud 12 via tube 92 and directs nitrogen to the surface of closure cap 32 at a relatively high velocity. Thus, tube 92 delivers inert gas to the inside of closure cap 32 directly and, via a venturi effect, the inert gas body within second portion 28 of shroud 12. In any event, nitrogen exiting nozzle 90 and nitrogen passing through diffusers 86 rinse oxygen from closure cap 32. Directional arrow 24 indicates the swinging of gripper 84 and closure cap 92 into and out of second portion 28 of shroud chamber 20.

A prior art programmable logic control, such as one manufactured by Allen-Bradly of Milwaukee, Wisconsin, is employed to activate and deactivate valve pairs 40 and 42, valve stem 60 of filling head 22, rotatable gripper 84, and other mechanical servo and pneumatic components of apparatus 10.

Employing apparatus 10, a novel method is depicted for substantially eliminating oxygen from the interior 82 of flexible bag 24.

Initially, bag 24 is loaded onto the filling head 22 by the use of a spout gripper 96, FIG. 2. Bag 24 is held in this position for a short period of time, typically 0.001 seconds, before a bag closure pad 72 is raised against lower film 78 of flexible bag 24. Lower film 78 will then press upwardly against spout 74 and upper film 76 of bag 24 to isolate the interior 80 of spout 34. This ensures that no influx of gasses may be introduced into bag interior 82. The un-capping portion of the bag filling cycle is then initiated where cap 32 is lifted out of spout 34 and rotated to the position shown in FIG. 3 within second portion 28 of the interior 20 of shroud 12. At this point, vacuum tubes 48 and 50 receive vacuum via pairs of valves 36 and 38. Filling valve 60 is then lowered and sealed against spout 34 into the position shown in FIG. 2. Once this occurs, bag closure pad 82 is lowered from films 76 and 78 to allow a path for air to be vacuumed out of bag interior 82 for a set time period, typically 0.25 seconds.

After this time period elapses, the bag closure pad 72 is raised to isolate spout interior 80 from interior 82 of bag 24. At this point, the vacuum through tube 48 is turned off and inert gas through tube 48 is turned on. This action displaces and cross flushes any residual oxygen from the interior 80 of spout 34 and purges any oxygen from conduit 44, tube 48, tube 50, and conduit 46. After a lapse, typically 0.25 seconds, vacuum valve pairs 36 and 38 are turned off.

At the cessation of the operation of vacuum valves 36 and 38, product filling valve stem 60 is opened according to directional arrow 62, and the proper amount of beverage is passed into the interior 82 of flexible valve 24 from beverage source 52. Following filling of bag 24, beverage filling valve stem 60 is closed (moved downwardly in FIG. 2) and nitrogen is injected from valve pairs 36 and 38 through tubes 48 and 50 and into the interior 80 of spout 34. This clearing of spout 34 moves residual liquid within spout 34 and breaks the surface tension of the product into fill valve stem 60. As nitrogen flows, bag closer pad 72 is again raised to seal the product into the interior 82 of bag 24.

After a short elapsed time, typically 0.0025 seconds, product filling valve stem 60 is lifted upwardly approximately 3 millimeters into a "seal break" position. Filling valve stem 60 remains in this position for a short period of time, typically 0.15 seconds. In this "seal break" position, valve pairs 36 and 38 apply vacuum to tubes 48 and 50 which removes residual beverage drips adhering to the fill valve surfaces. Such "seal break" creates a high velocity condition that essentially vacuums the entire circular seal area about valve stem 60. Thus, the low pressure of the vacuum applied to valve stem 60 is magnified to increase effectiveness.

Closure cap 32 is then rinsed of oxygen by the directing of nitrogen from nozzle 90 and through diffuser 86. Spout 34 is subsequently then lowered from filling head 22, cap 32 is rotated from shroud second portion 28 into a position over spout 34, and is reinserted into spout 34. Filled bag 24 is then ejected from the filling chamber.

It has been found that the concentration of oxygen in filled bag 24 is at a level of 1% or less.

While in the foregoing embodiments of the application have been set forth in considerable detail for the purposes of making a complete disclosure of the invention, numerous changes may be made in such details without departing from the spirit and principles of the invention.

What is claimed is:

1. A method of eliminating oxygen in the filling of an air filled flexible bag with a beverage through a bag spout having a placed closure cap, comprising:

providing a flexible bag closer pad, a source of inert gas, and a source of vacuum;

sealing the flexible bag against a portion of the bag spout by movement of said flexible bag closer pad;

removing the closure cap from the bag spout;

providing a vacuum to the bag spout from said source of vacuum;

unsealing the flexible bag against a portion of the bag spout by movement of said flexible bag closer pad to allow said vacuum to remove air from the flexible bag;

resealing the flexible bag against a portion of the bag spout by movement of said flexible bag closer pad;

providing inert gas to the bag spout from said source of inert gas;

unsealing the flexible bag against a portion of the bag spout by movement of said flexible bag closer pad;

filling the flexible bag with the beverage;

providing inert gas to the bag spout from said source of inert gas;

resealing the flexible bag against a portion of the bag spout;

providing a vacuum from said source of vacuum to the bag spout; and applying inert gas from said source of inert gas to the closure cap and placing the closure cap in the bag spout.

* * * * *